US012264485B2

(12) United States Patent
Olejnik

(10) Patent No.: US 12,264,485 B2
(45) Date of Patent: Apr. 1, 2025

(54) SURFACE SPATULA

(71) Applicant: Jacek Olejnik, Ramiszow (PL)

(72) Inventor: Jacek Olejnik, Ramiszow (PL)

( * ) Notice: Subject to any disclaimer, the term of this patent is extended or adjusted under 35 U.S.C. 154(b) by 325 days.

(21) Appl. No.: 17/752,768

(22) Filed: May 24, 2022

(65) Prior Publication Data

US 2022/0372771 A1 Nov. 24, 2022

(30) Foreign Application Priority Data

May 24, 2021 (PL) ..... 437968

(51) Int. Cl.
*E04F 21/16* (2006.01)

(52) U.S. Cl.
CPC ..... *E04F 21/161* (2013.01)

(58) Field of Classification Search
CPC ..... E04F 21/161; E04F 21/162; E04F 21/163
USPC ..... 15/143.1
See application file for complete search history.

(56) References Cited

U.S. PATENT DOCUMENTS

2020/0122314 A1* 4/2020 Rampling ..... B25G 3/24

* cited by examiner

*Primary Examiner* — Andrew A Horton
(74) *Attorney, Agent, or Firm* — Andrzej Malarz, Esq.

(57) ABSTRACT

A surface spatula has a frame provided on the surfaces of the gripping parts with a soft, convex covering (3) made of thermoplastic plastic, which is integrally bonded to the substrate on parts of the outer surfaces of the spatial structure of the frame, shaped in the form of a longitudinal profile (1), preferably made of hard engineering plastic, preferably from the group of plastomers, where the spatial structure of the profile (1) is a closed body, internally ribbed, with the same outline along its entire length, where the covering (3), also made in the form of surface elements (27), is present on the outer surfaces of the handgrip (2) and the connector (5), where in the frontal view of the outline of the profile (1) the manual handle (2) is located in the upper part and has a contour (15) similar to an ellipse and which in the lower part is connected with the outline of the connector (5), situated at the bottom part of the tool.

10 Claims, 8 Drawing Sheets

SURFACE SPATULA

CROSS REFERENCE TO RELATED APPLICATIONS

This patent application claims the benefit of Polish Patent Application No. P.437968, filed on May 24, 2021, the content of each is hereby incorporated by reference for all purposes.

FIELD OF INVENTION

This disclosure relates to the specialized surface spatula for use as a hand tool for obtaining smooth surfaces in construction industry and during renovations.

BACKGROUND

Generally the known spatulas consist of a handgrip—a handle of different shapes suitable for holding a tool in the hand of an operator performing puttying, and the working part of the tool, usually in the form of a thin plate, usually a metal plate, called a knife or a smoothing blade.

In prior art there are known differently shaped handgrips and different mounting structures of the thin plate. The surface spatulas are specialized hand tools which, in particular, may have a big length of the thin plate what allows to obtain larger smooth surfaces during performance of one pass of the tool by the operator.

In the related prior art, various technical solutions of surface spatulas are known, which are characteristic due to shapes of a handgrip and due to mounting structures of the thin plate.

From the Community Industrial Design No. RCD 002614677-0002 a shape of the handle of a hand-held tool called "Werkzeuggriffe" is known intended for filling surfaces. The tool consists of a handgrip which in its upper part has an elliptical shape and consists, beneath the grip, of a connector in the shape of the neck narrowing and consisting of a lower tool holder located on one side of the connector. The tool holder is connected to one side of the coupling and has a tool slot between the lower support and the upper short arm. In the tool slot, the working part of the tool is embedded in the form of a thin plate protruding beyond the tool slot.

From the US Publication No.: 2015225967A1, a spatula for obtaining smooth surfaces is known, which contains the shaped open handgrip, in which in the front view its profile is based on a plan similar to regular quadrilateral with a side incision on one of the sides from the side of the upper surface of a blade plate of the spatula.

From the European Patent No. EP2137364 a handgrip of a spatula is known which, from the front view, has a profile in the form of a relatively thin elongated handle protruding away from the position of the blade plate, where the profile has a recess below the handgrip under which the handle for the blade plate is located.

The Community Industrial Design No. RCD 04735553-0001 teaches plugs closing faces of the profile of the handgrip and a connector of the spatula.

From the European Patent No. EP3263801 a mounting structure of a blade plate in a spatula is known, in which a shape of the handgrip corresponds to the shape of the handgrip disclosed by the Community Industrial Design No. RCE 002614677. The tool holder according to this design includes a tool slot of a rectangular shape for the blade plate located in the lower part of the spatula, ended by a support with a catch.

From the Polish Patent Application No. P.427393 a mounting structure of a blade plate in a spatula is known, by application of an articulated bolt. The handgrip according to this solution has a U-shaped curved profile in the front view.

SUMMARY

The known surface spatulas for manual filling of surfaces are most often made of metal profiles, in particular, of aluminum. In order to develop the Applicant's surface spatula, technical analyses have been conducted relating to a shape of the handgrip, a mounting structure of a working piece in the tool and a way of usage of the surface spatula by an operator when making smooth surfaces in the construction industry and during renovations.

A technical problem to be resolved by construction of a hand tool for puttying according to the current patent application is construction of the surface spatula which does not contain defects of the putty tools presently available on the market, especially tools for puttying with metal handles that are by nature smooth and cause uncertainty while being held in a hand by an operator due to slippery surface of a grip.

In these analyzes has taken into account that the operation of puttying takes place under the conditions of applying a wet putty and inevitable is its splashing on the putty tool in particular also on its handgrip and, in particular, when it is made of aluminum, what reduces the grip of the hand of the operator on the handle of the putty tool.

In addition, it has been noticed that the hand putty tool made of metal profile is a good heat conductor and is cold when touched even when an operator is working with gloves, Also, it was taken into account that with a long use of the putty tool by the operator, especially when the length of the tool can reaches 2500 mm, the operator may feel the large weight of the tool. Thus, when developing the putty tool according to the present invention, it was considered that these problems should be solved, in particular to obtain, by the operator of a hand putty, the tool of higher surface quality and higher efficiency of his work, with less physical efforts, in particular when working for a long time, and in particular when working on large surfaces using the putty tool of a long length, and in order to obtain a good grip on the tool.

Also, a significant problem in developing the Applicant's spatula was need of easy replacement of the worn working element—thin plate i.e. the smoothing blade or knife.

The invention presents technical solutions responding to the above problems associated with obtaining a technical effect in use of a hand putty tool. According to the invention, the hand putty tools intended especially for larger surfaces in the form of a surface spatula consist of known elements in the form of a holder including a handgrip and a tool holder in which the working part of the tool is mounted separately in the form of a thin plate, also called as a knife or a smoothing blade. In the Applicant's solution, there is a shaped connector between the handgrip and the tool grip in a frame of the surface spatula.

According to the disclosure, the frame of the surface spatula is provided on surfaces of the gripping parts with a soft, convex covering made of thermoplastic plastic. The soft covering is integrally bonded to the substrate on parts of the outer surfaces of the spatial structure of the frame, formed in the form of an elongated profile. The frame preferably it is made of a hard engineering plastic, preferably from the group of plastomers.

The spatial structure of the frame is a closed, internally ribbed body with the same profile along its entire length. A soft covering, including these made in the form of surface elements, occurs on the outer surfaces of the handgrip and the connector. Appearing in the frame elements of the spatial structure of the profile, in the parts including the handgrip and the connector, have a familiar spatial form.

In the front view of the outline of the profile, the handgrip is located in the upper part of the frame and has a contour shape similar to an ellipse. This contour in the lower part with gentle concave gaps is connected with the contour of the shape of the connector, narrow in relation to the handgrip located in the lower part of the frame. The connector has a junction in the middle of its height and is positioned asymmetrically in relation to the handgrip.

From one side of the connector, to its lower part a lateral spatial structure of the frame is connected in the form of an extended arm and a support is attached to the same side of the connector, located below the arm. In the frame of the surface spatula, between the arm and the support there is a tool seat with a two-part open, tool slot space. The tool slot space consists of a wedge slot and a rectangular slot. In the tool slot, a seating part of a working piece for direct puttying, known as a thin plate, is secured and fastened, preferably detachably. The seating part of the thin plate is positioned longitudinally in the frame by plug plates which are seated and close, preferably separately, the face of the profile of the frame. The plug plate has a shape matching an outline of the face of the spatial structure of the frame of the profile. The plug plate from the outer side has a flat surface and on the inside it is provided with a stiffening protrusion, retaining protrusions and clamping protrusions.

In the surface spatula according to the present disclosure, the tool slot is an open space, going through along the length of the profile of the frame and in the frontal view of the outline of the profile of the frame it is closed on the side of the connection with the connector. The width of the tool slot consists of the width of the first wedge part located closer to the connector. The wedge part is an empty part of the tool slot shaped in the form corresponding to the shape of a one-sided wedge. The second perpendicular part of the tool slot, located further from the connector, behind the wedge part, is an empty part of the tool slot shaped in the form of a very thin cuboid, with a height much smaller than its width. The tool slot in the wedge part is smaller than its width. The tool slot in the wedge part has a variable height, the lowest at the side of the connection with the connector and the highest at the end of the width farthest from the connector of the profile of the frame.

The upper surfaces of the tool slot in the wedge part and in the perpendicular part constitute jointly the lower outer surface of the wall of the spatial structure of the arm in the frame. The lower surface of the tool slot is the upper, flat, outer surface of the support in the tool seat. The support is positioned as the lowest, lower part of the profile of the frame and connected to the lateral side of the connector in its lower part. The uniform shape of the support in the tool holder in the profile of the frame consists of its parts together: the part directly connected with the connector, with a shape close to a cuboid, and the further part of the support, distant from the connector, in the shape close to a one-sided wedge. The width of the upper surface of the support is made up of the width of the surface in the perpendicular part and the wedge-shaped part in total. The height of the support in the rectangular portion is preferably at least twice the thickness of the walls in the parts including the spatial structures of the handgrip and the connector of the profile of the frame. The arm in the frame is the ribbed from inside spatial structure, having several internal shaped chambers, preferably four chambers, separated by ribs. The arm in frame has an external shape in the form of a one-sided wedge, with a variable height—the largest at the connection with the connector, in the part located above the tool slot, in its wedge part, and the lowest height at the end of the arm, farthest from the connector. The end of the arm is rounded at the top. The total length of the arm is greater than the width of the tool slot by 3 to 6 times, preferably 4 times. The arm of the frame in the extension of the lower flat part of the surface, in the rectangular part of the tool slot, has a distal flat part of the lower surface extended to its end.

The profile on the gripping parts of the surface putty holder has, integrally connected to the substrate, a soft covering of the outer surfaces of the outline of the handgrip and the outline of the connector, preferably in the form of surface elements, covering part of the outer surfaces of the handgrip and part of the outer surfaces of the connector and extending along the entire length of the section of the holder. The surface elements are preferably shaped in the form of strips, each having a width of 1 to 15 mm, preferably a width of 5 mm.

In the frame, of the surface spatula according to the disclosure, the surface elements present on the contour of the handgrip and the connector along the length of the profile of the frame, preferably appear in the form of stripes, arranged with an uneven circumferential scale along the contour of the handgrip, preferably in the form of parallel stripes. In the profile of the frame, the strips are preferably located on the contour of the connector and the contour of the handgrip and are at least and preferably positioned in such a way that at least one strip is on the contour side of the handgrip located above the tool seat, at least one strip is located on the contour of the handgrip on the other opposite side of the contour of the handgrip and at least three strips are on the upper part of the contour of the handgrip and at least one strip is at the bottom of the contour of the handgrip and at least one strip located on both sides of the contour of the connector, preferably in its neck constriction.

In the spatial structures of the handgrip and connector of the profile of the frame in the surface spatula according to the disclosure, the outer walls are provided with surface recesses corresponding to the shape of the surface elements and which are positioned appropriately in places intended for the surface elements, including those preferably in the form of stripes. The recesses are made on a portion of the outer surfaces of the handgrip and connector. The outer walls of the spatial structures of the handgrip and the frame connector are preferably suitably locally thickened towards the inside of the spatial structure of the frame at the locations of recesses.

In the surface spatula according to the disclosure, in the front view of the profile of the frame, in the spatial structure of the handgrip there are several, preferably six, internal hollow chambers, including side chambers on both sides of the contour of the handgrip and lower chambers in the contour of the handgrip, which are shaped by the outer walls of the contour of the handgrip sectional and separated by the inner ribs of the handgrip, preferably in the form of crossed ribs. In the position where the lower surface of the arm is in the horizontal position, the ribbing of the handgrip consists of at least two vertically oblique ribs and at least one horizontally oblique rib. In the spatial structure of the arm, there are several, preferably four, hollow chambers formed by its outer contour and internally separated by at least four, preferably vertically inclined ribs.

In the spatial structure of the profile of the frame in the tool seat of the surface spatula according to the disclosure, a seating part of the known working element for direct filling, in the form of a thin plate with a rounded working tip, preferably in the form of a metal plate, is fixed and fastened, preferably in a detachable manner. The seating portion of the plate of the surface spatula is located, preferably releasably, in the tool holder in the tool slot.

Fixing of the thin plate is made in such a position where one of the longer edges of the thin plate is brought into a contact, by pushing the wedge part of the tool slot as far as possible to close, at the point of its lowest height, which corresponds to the thickness of the thin plate.

The height of the tool slot, in its rectangular part, corresponds to the thickness of the thin plate embedded in the tool slot. The upper surface of the seating portion of the thin plate is fixed adjacent the lower surface of the arm over a width corresponding to the joint width of the tool slot in the rectangular portion and the width of the distal flat portion of the lower surface along the length of the arm up to its end. The lower part of the seating part of the thin plate in the tool seat adheres to the upper, flat surface of the support. Moreover, in the seating part of the thin plate, several, at least two, known local grooves are formed on its upper surface, preferably obtained by cutting through the thickness of the thin plate and their vertical bends. The cuts in the seating part in the thin plate are made at a distance from the longer edge of the seating part of the thin plate, in places which, after fixing the seating part in the tool seat, correspond to the greatest height of the wedge part in the tool slot and the height of which corresponds to the greatest height of the grooves. The width of the tool holder, measured from the beginning of the width of the tool slot in its wedge part, along the lower surface to the end of the arm, in relation to the total width of the thin plate, is in the ratio 4:10, preferably in the ratio 5:9.

In the surface spatula, according to the disclosure, the seating part of the thin plate is longitudinally positioned between the double-sided plug plates closing the faces of the profile of the frame. The plug plates are made of a tough engineering plastic from the chemistry group and are flat on one side on the outside. The plug plates are fixed in one of the central inner chambers in the spatial structure of the mount arm. In the front view of the profile of the frame, the central chamber in the arm has a shape similar to a trapezoid with non-parallel bases, with a lower, shorter trapezoidal base parallel to the outer surface of the arm.

In the front view of the profile of the frame, the plug plates are fixed inside the central chamber through stiffening projections on the inner surfaces of the plug plates. The stiffening protrusions are located on the inner walls of the plug plates, corresponding to the position of the central chamber in the spatial structure of the arm of the frame, and the protrusions have an outer shape corresponding to that of the central chamber. Moreover, on the inner surfaces of the plug plates are made the known retaining protrusions are also provided, positioned according to the position of the inner chambers within the spatial structure of the handgrip in the profile of the frame. In addition, the plug plates have the known upper and lower clamping protrusions on their internal surfaces, securing each of the plugs to the profile of the frame. Each of the clamping protrusions has vertically arranged cylindrical pins, elastically bent and clamped in the installation of the plug plates to the profile of the frame, in through cylindrical openings made and appropriately positioned in the walls of the profile of the frame near the faces of the frame profile. The upper clamping protrusions are positioned respectively in the upper openings made in the upper part of the wall of the spatial structure of the handgrip of the frame, and the lower clamping protrusions are respectively fixed in the lower openings made in the lower part of the wall of the profile of the frame.

In the inventive surface spatula, the profile of the frame and the plug plates are made of engineering plastic with a hardness of 65 to 75, preferably 70 in the Shore D hardness scale. The covering and the surface elements are made of soft plastic with a hardness of 60 to 70, preferably 65 in the Shore A hardness scale.

According to the present disclosure, in the surface spatula, a shape of the frontal outline of the spatial structure of the profile of the frame, with its spatial arrangement, in which the lower flat part of the arm surface lies on a horizontal plane, means that one of the planes perpendicular to it is tangent on one side to the convex part of the contour of the handgrip and is an incisal plane passing through the tool slot, preferably cutting through its wedge part in the tool holder. The second plane, which is also perpendicular to the horizontal plane on which the lower flat part of the surface of the arm lies and which is tangent on the other side to the convex part of the contour of the handgrip contour, is dimensionally distant from the first tangent plane to the contour of the handgrip from 40 mm to 110 mm, preferably at a distance of 65 mm.

In addition, another plane perpendicular to horizontal plane is a secant passing through the middle part of the shape of the connector, the width of which in the neck constriction ranges from 10 mm to 30 mm, preferably 15 mm. The plane tangent to the upper part of the contour of the handgrip contour and parallel to the horizontal plane is dimensionally distant in the range from 40 mm to 70 mm, preferably at a distance of 45 mm.

Further, the incisal plane on which the longest chord of the shape of the contour of the hand handle, is a plane inclined in relation to the horizontal plane, while the acute linear angle of the dihedral angle between these planes is from 7° to 15°, preferably 10°, and a top of the sharp and a vertex of the acute linear angle lies on the horizontal plane and is beyond the end of the arm.

The technical solution of the surface spatula according to the present application, brings favorable qualitative technical effects when used by an operator who makes smooth surfaces of building partitions, including walls and ceilings.

The use of soft covers of the handle of the hand tool allows for a firm and good grip of the tool by the operator, which increases the possibility of obtaining a higher surface quality and increases the operator's work culture.

Implementation of the plastic tool holder, according to the present disclosure, with a soft covering of its handgrip considerably reduces the weight of the surface specula.

The technical solution of the frame, due to the rigid structure of the spatial structure of the plastic section, will increase the operator's work efficiency, especially during long-term manual work with this tool and large lengths of the profile of the frame.

A combination of covering the surface of the handgrip in the frame, made of soft plastic, ensures a secure and durable connection with the structural plastic of the profile of the frame profile. Such a permanent connection of materials is in fact a difficult to obtain while manufacturing a metal handgrip known in prior art.

Embedding the working element of the thin plate in the frame according to the present application, in the elongated tool seat, resulting from the spatial structure in the arm structure and the rigid support, and by stiffening the structure with the help of appropriate protrusions in the plugs, entering the chamber in the arm, increases the possibility of obtaining the surface quality and the operator's work efficiency by rigid fastening of the thin plate and ensures easy exchange of the working element when its working edge is worn out.

BRIEF DESCRIPTION OF THE DRAWINGS

The subject of the solution is shown in the attached drawings where.

DETAILED DESCRIPTION OF THE PREFERRED EMBODIMENTS

Figure 1:
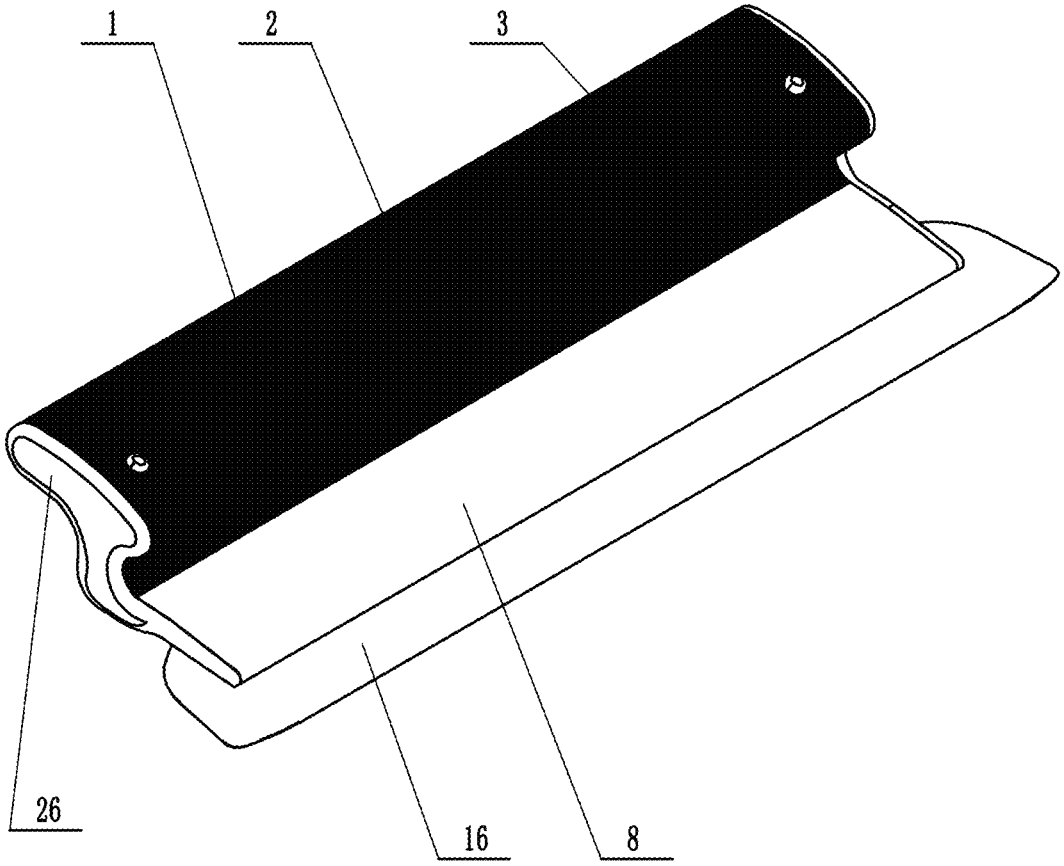
FIG. 1 shows a front right side perspective view of the surface spatula.
Figure 2:
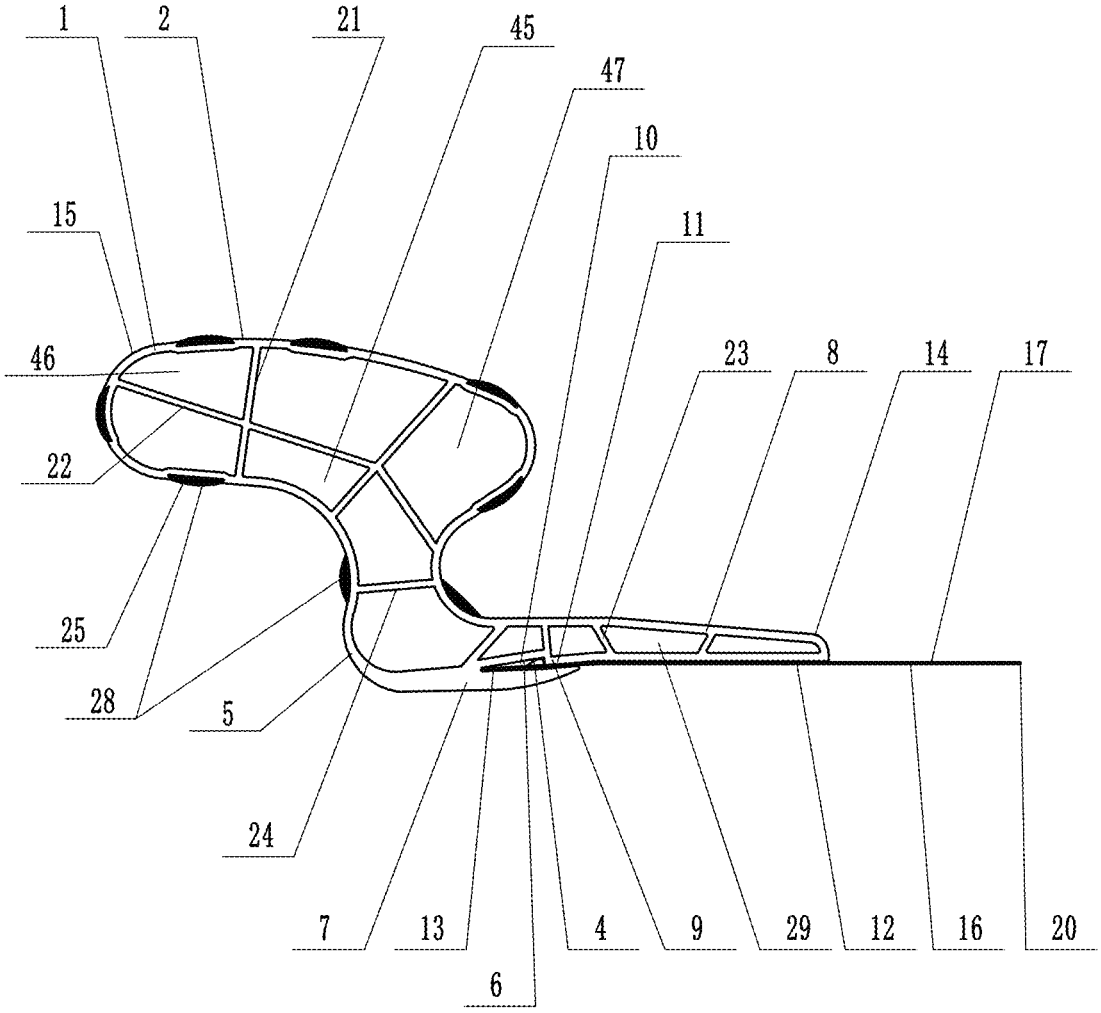
FIG. 2 shows a right side view of the surface spatula with the embedded smoothing thin plate in the tool seat.
Figure 3:
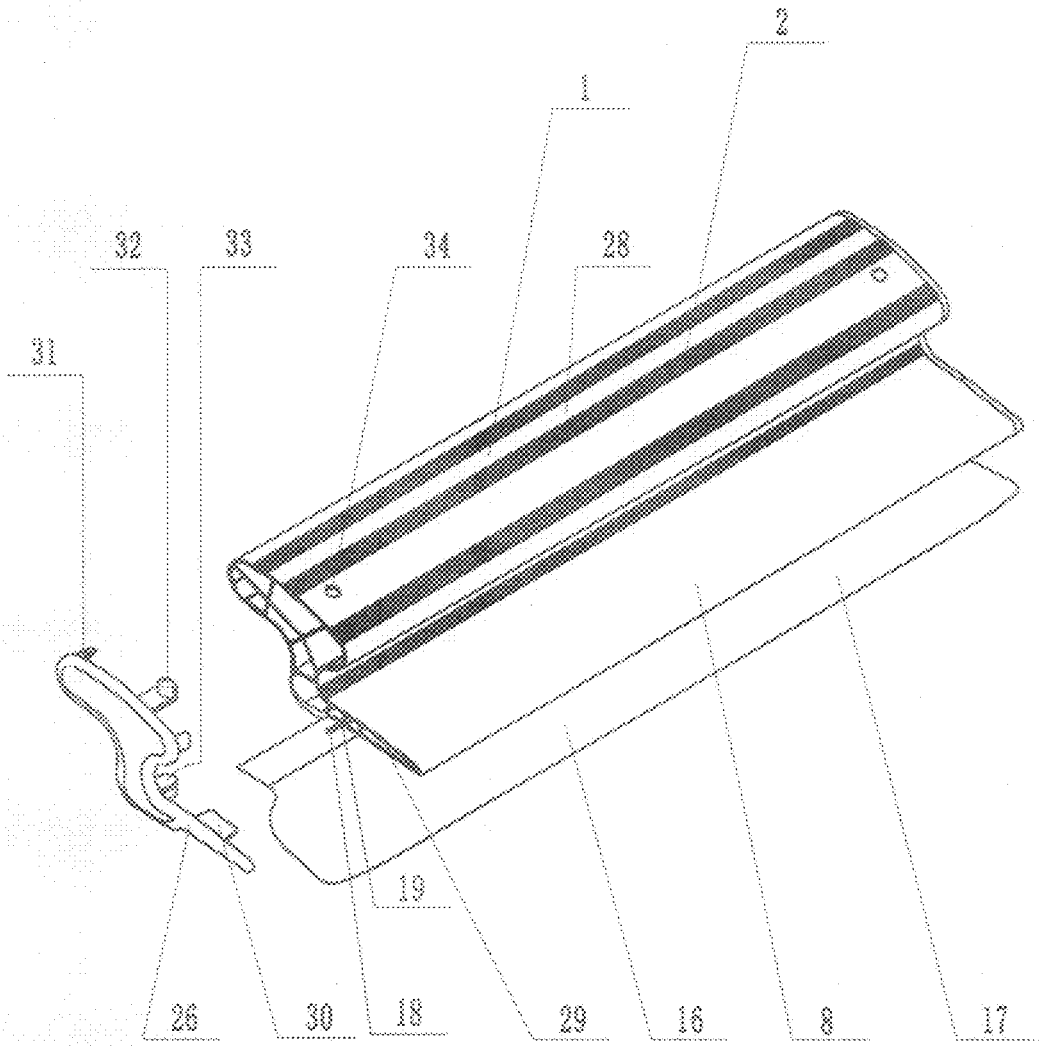
FIG. 3 shows an exploded view of the surface spatula with the extended smoothing thin plate, fastening elements, a removed plug, and in the version of the manual grip and connector covered with strips made of soft plastic.
Figure 4:
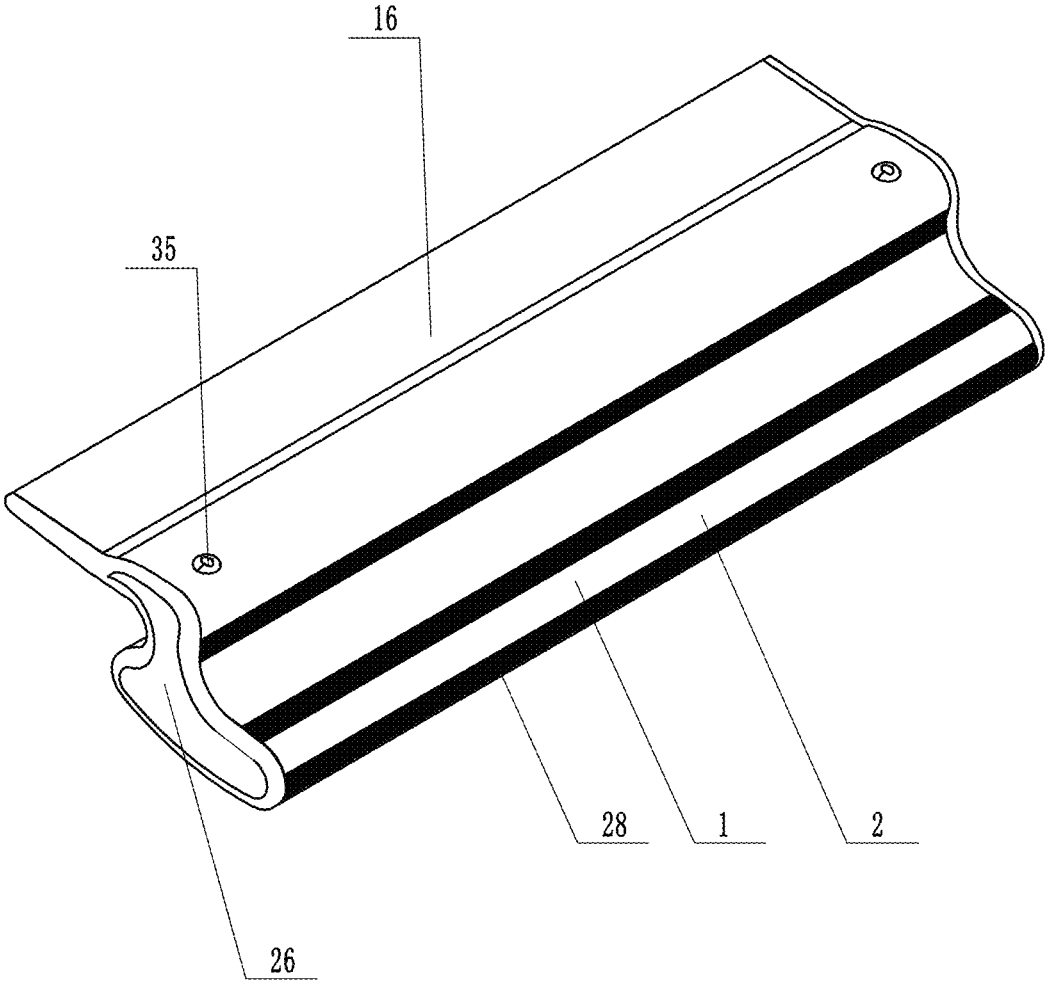
FIG. 4 shows an inverted holder of the surface spatula shown in FIG. 3.
Figure 5:
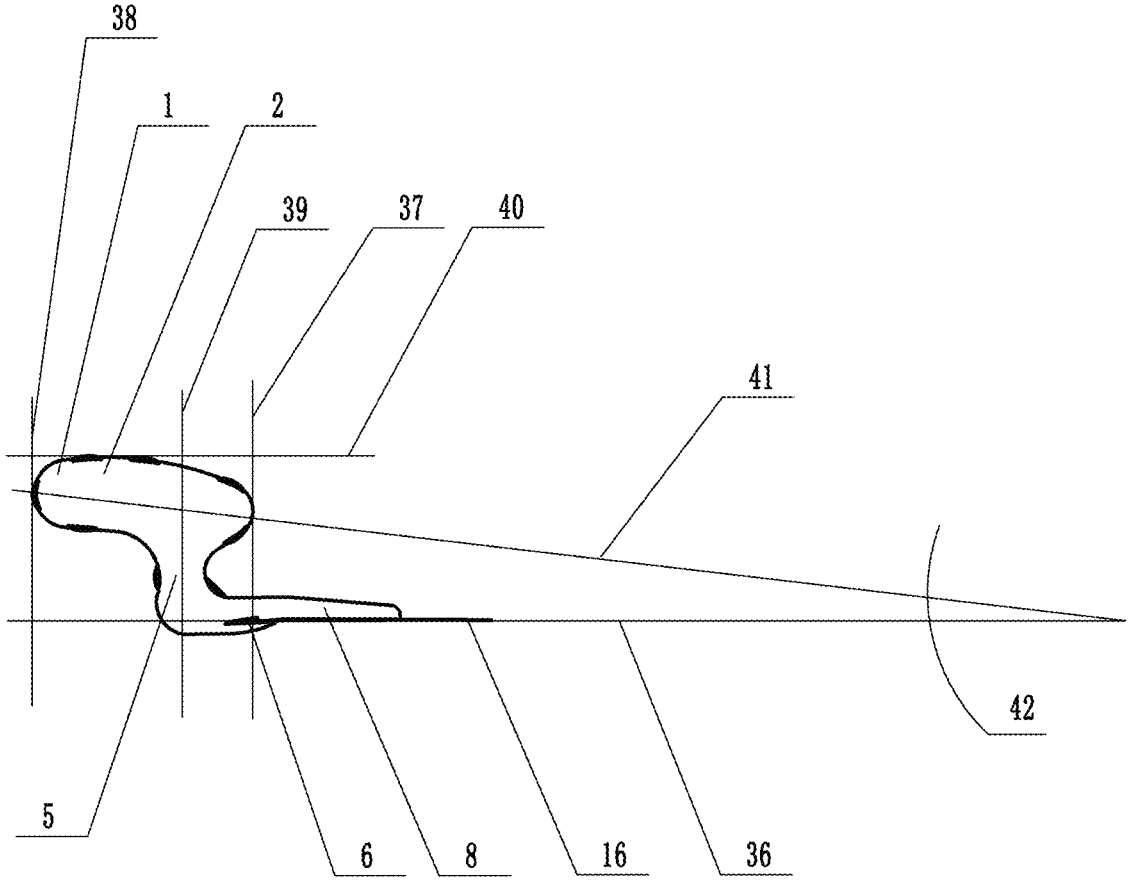
FIG. 5 shows an end view of the holder with the imaginary planes marked determining the shape features of the profile of the frame.
Figure 6:
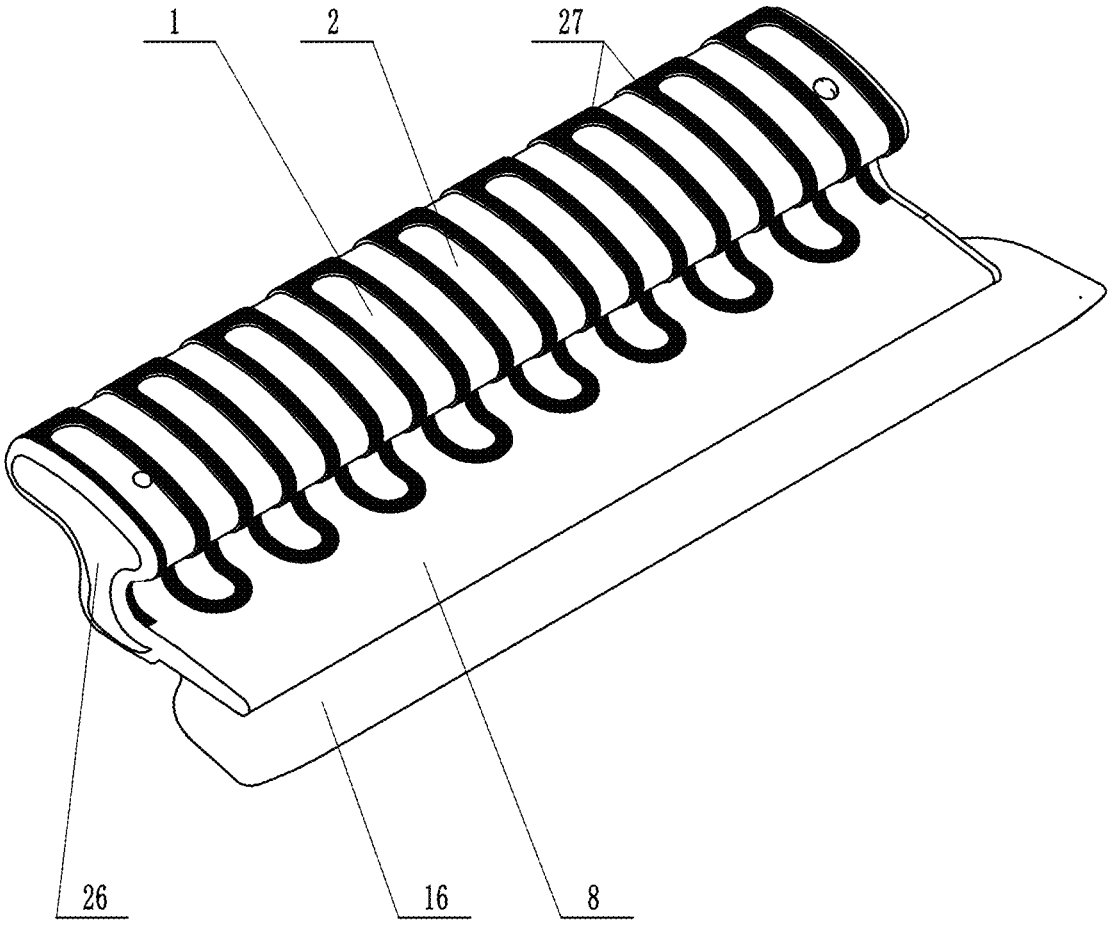
FIG. 6 shows another front right side perspective view of the surface spatula in which the handgrip is covered with stripes transversely located in relation to the length of the profile of the frame.
Figure 7:
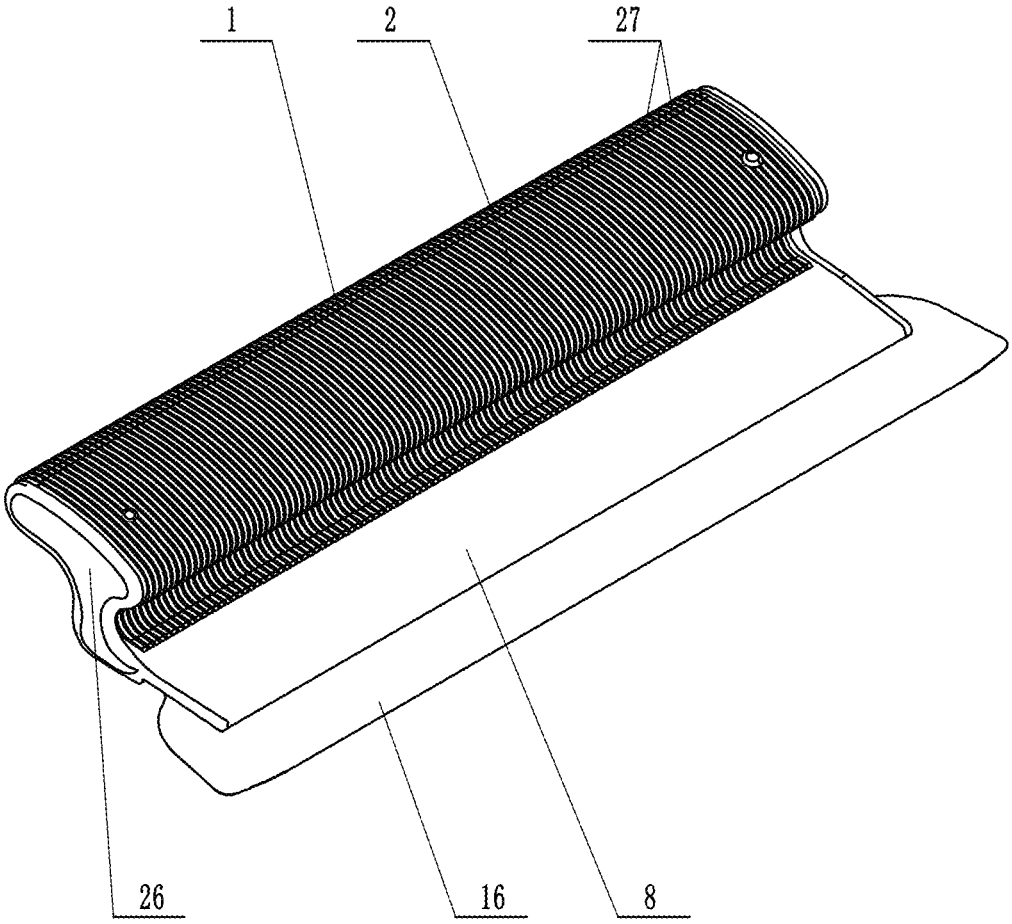
FIG. 7 shows another front right side perspective view of the surface spatula in which the handgrip is covered with many thin strips positioned closely at intervals and transversely to the length of the profile of the frame.
Figure 8:
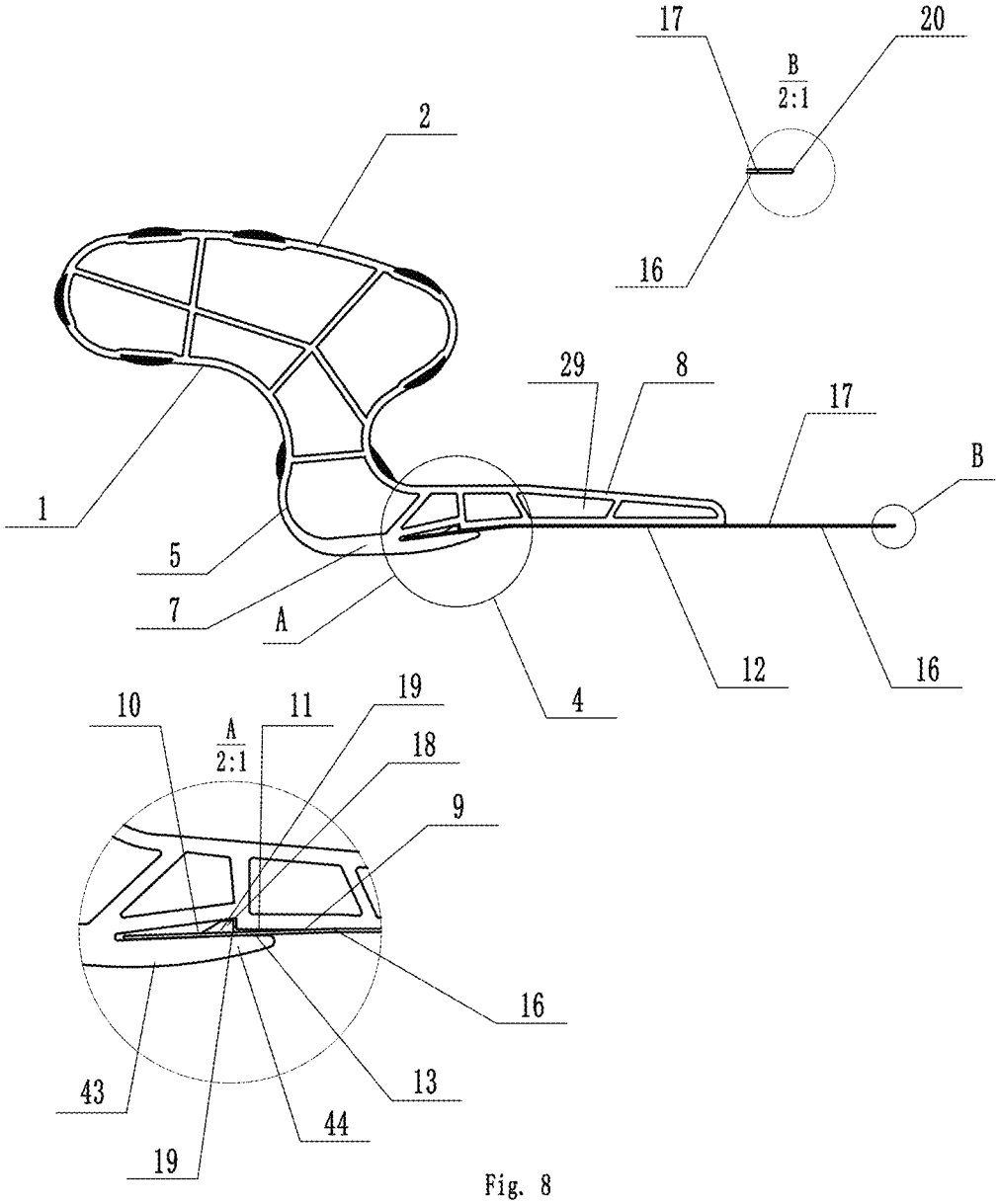
FIG. 8 shows a front view of a three-dimensional structure of the holder of the surface spatula, with detail A of the thin plate seating in the tool seat and detail B showing a rounded tip of the thin place.

In the first embodiment, according to the disclosure, the surface spatula consists of a frame, in which the working part of the tool is installed in the form of a thin plate 16. The basic element of the surface spatula is a longitudinal profile 1 made of structural, hard plastic, made of polyvinyl chloride PVC-AT. The profile 1 is closed at its ends with shaped plugs 26. The thin plate 16 is embedded in the tool holder 4 in the profile 1. The spatial structure of the profile 1 is a closed internal ribbed body with the same outline along its entire length.

In the first embodiment of the surface spatula according to the disclosure, in the frontal view of the outline of the profile 1, the handgrip 2 is located in the upper part of the profile of the frame and has a contour 15 similar to an ellipse. The contour 15 of the handgrip 2 in the lower part is connected with the contour shape of a connector 5 by gentle, concave arcs. In the lower part of the frame there is the connector 5, which is narrow in relation to the shape of the handgrip 2. The connector 5 has a neck constriction in the middle of its height and asymmetrically in relation to the handgrip 2. On one side of the connector 5, towards its lower part, a lateral spatial structure of the frame in the form of an extended arm 8 is attached, and a support 7 is attached to the same side of the connector 5, located below the arm 8. In the profile 1 between the arm 8 and the support 7 there is a tool seat 6 with the two-part, open space of the tool slot 9, consisting of a wedge slot 10 and a rectangular slot 11. In the tool slot 9 is fixed and detachably fastened, the seating part of the thin plate 16 and fixed longitudinally in the frame by plug plates 26, which are detachably seated and close faces of the profile 1 of the frame. The plug plate 26 has a shape corresponding to the contour of the face of the spatial structure of the profile 1 of the frame. The plug plate 26 has a flat surface on the outside, and on the inside it is provided with a stiffening protrusion 30, with retaining protrusions 31 and with clamping protrusions 32 and 33. The tool slot 9 is part of an open, hollow space along the length of the profile 1 of the frame. In the frontal view of the outline of the profile 1, the tool slot 9 is closed on one side, at the connection side with the connector 5. The width of the tool slot 9 consists of the width of its first wedge part 10 and the width of its second rectangular part 11. The wedge part 10 is the hollow part of an open space shaped in the shape of a one-sided wedge, located closer to the connector 5.

The second cuboidal part 11 is situated further from the connector 5 behind the wedge part 10 and is part of a hollow, open space, shaped in the form of a very thin cuboid, with a height much less than its width. The tool slot 9 in the wedge part 10 has a variable height, the lowest on the side of the connection with the connector 5 and the highest at the end of its width, further away from the connector 5. The upper surfaces of the tool slot 9, in the wedge part 10 and in the rectangular part 11 together constitute the lower outer surface 12 walls of the spatial structure of the arm 8 in the frame.

The lower surface of the tool slot 9 is the upper, flat, outer surface 13 of the support 7 in the tool seat 6. The support 7 is positioned as the lowest lower part of the profile 1 of the frame and connected to the lateral side of the connector 5 in its lower part. The uniform shape of the support 7 in the tool holder 4 in the profile 1 of the frame consists of together its parts: a part 43 directly connected with the connector 5, with a shape similar to a cuboid, and a further part 44 distant from the connector 5, in the shape of a one-sided wedge. The width of the upper surface 13 of the support 7 is made up of a total width of the surface in its rectangular part 43 and the surface in the wedge-shaped part 44. The height of the support 7 in the rectangular part 43 is twice as large as the thickness of the walls in the parts including the spatial structures of the handgrip 2 and of the connector 5. The arm 8 in the frame is an internally ribbed spatial structure having four internal shaped chambers separated by ribs. The arm 8 has an external shape in the form of a one-sided wedge, with variable height—the largest at the connection with the connector 5, in the part located above the tool slot 9, in its wedge part 10 and the lowest height the arm 8 has at the end 14 of the arm 8, located furthest from the connector 5.

The end 14 of the arm 8 is rounded at the top. The total length of the arm 8 is four times the width of the tool slot 9. The arm 8, in the extension of the lower flat part of the rectangular 11 tool slot 9, has a further flat part of the lower surface 12 extended to its end 14.

The profile 1 of the frame on the grip parts of the frame has a soft covering 3, integral with the substrate. The covering 3 covers the entire outer surface of the contour 15 of the handgrip 2 and the outline of the connector 5. The covering 3 is made of a soft polyvinyl chloride—PVC-P. In the spatial structure of the profile 1 of the frame, the handgrip 2 has six internal hollow chambers, including: side chambers 45 and 47 on both sides of the contour 15 and bottom chambers 46. Side chambers 45 and 47 and bottom chambers 46 are formed by the outer walls of the contour 15 of the handgrip 2 of the profile 1 and separated by the internal ribbing of the handgrip 2, in the form of crossed ribs. The ribbing in the frontal view of the profile 1 of the frame, when the lower surface 12 of the arm 8 is in the horizontal position, consists of two vertically inclined ribs 21 and one rib 22, oblique to the horizontal. In the spatial structure of the arm 8, there are four hollow chambers formed by its outer contour and internally separated by four vertically oblique ribs 23. The connector 5 has ribbing in the form of one horizontal rib 24.

In the tool seat 6 of the profile 1 of the frame of the surface spatula, a part is fixed which is the bearing portion of the smoothing thin plate 16. The thin plate 16 is a thin steel plate with a rounded working edge 20. The seating portion of the thin plate 16 is retained and detachably fastened in the tool holder 4 in the tool slot 9. The arrangement of the plate 16 is made in its position, in which one of the its longer edges are brought into contact by bringing the wedge part 10 of the tool slot 9 as far as it will stop. This is the place with its lowest height, which corresponds to the thickness of the smoothing thin plate 16. The height of the tool slot 9, in its rectangular part 11, corresponds to the thickness of the plate 16.

The upper surface 17 of the seating portion of the plate 16 is fixed abutting the lower surface 12 of the arm 8, over a width corresponding to the total width of the tool slot 9 in the rectangular portion 11 and the distal flat portion of the lower surface 12, up to the end 14 of the arm 8.

The lower part of the surface of the seating portion of the thin plate 16 in the tool seat 6, adjoins the upper, flat surface 13 of the support 7. In the seating part of the smoothing thin plate 16, three local grooves are made on its upper surface 17, and their vertical bends. The cuts 19 in the seating portion of the thin plate 16 are made at places and at such a distance from the long edge of the seating portion of the smoothing thin plate 16 that after the seating portion of the thin plate 16 has been fixed in the tool seat 6, these places correspond to the greatest height of the wedge portion 10 in the tool slot 9. Height coves 18 corresponds to the greatest height in the tool slot 9 in the wedge part 10. The width of the tool holder 4 is measured from the beginning of the width of the tool slot 9 in its wedge portion 10, along the lower surface 12 to the end 14 of the arm 8, with respect to the total width of the thin plate 16 is 5:9. The seating portion of the thin plate 16 is longitudinally positioned between the double-sided plates plugs 26, closing faces of the profile 1 of the frame. The plug plates 26 are made of the hard PVC-U polyvinyl chloride.

The plug plates 26 are outer one-sided flat. The plug plates are established in the middle internal chamber 29 in spatial structure of the arm 8 of the frame. In the frontal view of the profile 1 of the frame, the middle chamber 29 of the arm 8 has a shape similar to the trapezoid with uneven bases, with a lower shorter basis of the trapezoid parallel to the outer surface 12 of the arm 8. Arrangement of the plug plates 26 is made in the middle internal chamber 29 by the stiffening protrusions 30, made on internal surfaces of the plug plates 26, corresponding to the position of the central chamber 29 in the spatial structure of the arm 8 of the frame. The stiffening protrusions 30 in the plug plates 26 have an outer shape corresponding to the shape of the chamber 29.

On the inner surfaces of the plug plates 26 there are also retaining protrusions 31, corresponding in shape and positioning to the position of the inner chambers 45, 46 and 47 within the spatial structure of the handgrip 2 in the profile 1 of the frame. The plug plates 26 have upper 32 and lower 33 clamping protrusions on their internal surfaces, fixing each of the plugs 26 to the profile 1 of the frame. Each of the clamping protrusions 32 and 33 has vertically arranged cylindrical pins which are elastically deflected and clamped in mounting of the plug plates 26 to the profile 1 of the frame in through cylindrical openings 34 i 35, made and appropriately located in the walls of the frame near the faces of the profile 1 of the frame.

The upper clamping protrusions 32 are fixed in the upper openings 34 made in the upper part of the wall of the spatial structure of the handgrip 2 of the frame, and the lower clamping protrusions 33 are fixed in the lower openings 35 made in the lower part of the wall of the connector 5 of the profile 1 of the frame.

The profile 1 of the surface spatula and the plug plates 26 are made of hard PVC-U polyvinyl chloride with a hardness of 70 on the Shore D hardness scale. The cover 3 of the handgrip 2 and the connector 5 is made of a soft PVC-P polyvinyl chloride with a hardness of 65 Shore A hardness scale.

The shape of the frontal outline of the spatial structure of the profile 1 of the frame, with its spatial arrangement in which the lower flat part of the surface 12 of the arm 8 lies on the horizontal plane 36, is characterized by the fact that one of the planes 37 perpendicular to it is tangent on one side to the convex part of the contour 15 of the handgrip 2 and is the incisal plane 37 passing through the tool slot 9 in its wedge part 10.

The second plane 38, also perpendicular to the horizontal plane 36 and tangent on the other side to the convex part of the contour 15 of the handgrip 2, is dimensionally distant from first tangent plane 37 to the contour 15 of the handgrip 2 at a distance of 65 mm. Another plane perpendicular to the horizontal plane 36 is the incisal 39 passing through the center of the width of the shape of the connector 5. The width of the connector 5 in the neck constriction is 15 mm. The plane tangent 40 to the upper part of the contour 15 of the handgrip 2 and parallel to the horizontal plane 36 is at a distance of 45 mm. The incisal plane 41, on which the longest chord of the contour 15 of the handgrip 2 lies, is a plane inclined 41 with respect to the horizontal plane 36. The linear acute angle 42 of the dihedral angle between these planes 36 and 41 is 10° and the apex of the linear acute angle 42 lies on horizontal plane 36 and is outside the end 14 of the arm 8.

In the second embodiment of the surface spatula according to the present disclosure, the profile 1 and the plug plates 26 in the frame of the surface spatula are made of polyamide. The spatial structure of the frame is the same as in the first embodiment. In this embodiment of the spatula there is also the same structure for retaining and releasably fixing the seating part of the thin plate 16 in the tool holder 4, with the use of shaped plug plates 26 detachably closing the profile 1 of the frame.

In a second embodiment of the surface spatula according to the disclosure, the frame is provided with soft, convex surface elements 27 bonded integrally to the substrate and which are made of soft PVC-P polyvinyl chloride. The surface elements 27 cover part of the outer surfaces of the contour 15 of the handgrip 2 and the connector 5 and extend along the length of the profile 1 of the frame. The surface elements 27 are formed as stripes 28, each 5 mm wide. The stripes 28 are arranged with a non-uniform circumferential pitch on the contour 15 of the handgrip 2 and are parallel. The stripes 28 are located on the contour of the connector 5 and on the contour 15 of the handgrip 2 and are positioned such that one strap 28 is on the contour side 15 of the handgrip 2 located above the tool seat 6, one strap 28 is on the other opposite side of the contour 15 of the handgrip 2 and three stripes 28 are on the upper part of the contour 15 of the handgrip 2, and one strap 28 is provided on the lower side of the contour 15 of the handgrip 2, and one strap 28, located on both sides of the contour of the connector 5, in its neck constriction. The outer walls of the handgrip 2 and the connector 5 of the profile 1 are provided with surface recesses 25, corresponding to the shapes of the strips 28 and which are positioned respectively in the places intended for the strips 28.

The outer walls of the handgrip 2 and the connector 5 of the frame are provided with the position of the recesses 25 locally bold towards the inside of the spatial structure of the frame.

In the third embodiment of the surface spatula, according to the present application, the profile 1 and the plug plates 26 in the frame are made of hard PVC-U polyvinyl chloride. The spatial structure of the frame is the same as in the first embodiment. In this embodiment occurs also the same structure of retaining and fixing the seating part of the thin plates 16 in the tool holder 4, with the use of shaped plug plates 26 closing the profile 1 of the frame.

In the third embodiment of the surface spatula, according to the solution, the frame of the surface spatula is provided with soft, convex surface elements 27 bonded integrally to the substrate and which are made of soft PVC-P polyvinyl chloride. The surface elements 27 cover part of the outer surfaces of the contour 15 of the handgrip 2 and the connector 5 and extend along the length of the profile 1. The surface elements 27 are made of continuous and parallel stripes located transversely to the length of the profile 1, and 5 mm wide and with a 5 mm scale. The stripes are connected at the ends of the contour 15 of the handgrip 2 and the connector 5. There are recesses on the surfaces of the walls of the handgrip 2 and the connector 5, located according to the shape and arrangement of the stripes, respectively, and the thickness of the walls in these places is appropriately increased in accordance with the recesses on the surface of the handgrip 2 and connector 5.

In the fourth embodiment of the surface spatula, according to the disclosure, the profile 1 and the plug plates 26 in the frame are made of hard PVC-U polyvinyl chloride. The spatial structure of the frame is the same as in the first embodiment. In this embodiment, there is also the same structure for retaining and fixing the seating portion of the thin plate 16 in the tool holder 4, with the use of shaped plug plates 26 closing the profile 1 of the frame. The frame is provided with soft, convex surface elements 27 integrally bonded with the substrate and which are made of soft PVC-P polyvinyl chloride. The surface elements 27 of the cover part of the outer surfaces of the contour 15 of the handgrip 2 and the connector 5 and extend along the length of the profile 1 of the frame. The surface elements 27 are made of continuous and parallel stripes transverse to the length of the profile 1, and 1 mm wide and with a 1 mm pitch. The stripes are connected at the ends of the contour 15 of the handgrip 2 and the connector 5. The wall thickness in the places where the strips are present is correspondingly increased according to the position of the recesses on the surface of the handgrip 2 and the connector 5.

The frame of the surface spatula, according to the disclosure, is characterized by high usability and by providing the operator with a good grip of a tool with a relatively low weight what allows to increase the quality and efficiency of the operator's work, and consequently to make smooth putty surfaces of building partitions in accordance with the requirements of standards in this regard.

LIST OF REFERENCE NUMERALS

1. Profile of the frame
2. Handgrip
3. Soft covering of the grip parts of the frame
4. Tool holder
5. Connector
6. Tool seat
7. Support
8. Arm
9. Tool slot
10. Wedge part
11. Rectangular part
12. Lower surface of the arm
13. Upper flat surface of the support
14. End of the arm
15. Contour of the handgrip
16. Thin plate
17. The upper surface of the seating portion of the thin plate
18. Grooves in thin plate
19. The cut in the seating portion of the thin plate
20. Working part of the thin plate
21. Rib oblique to the vertical
22. Rib oblique to the horizontal.
23. Rib in the arm
24. Rib in the connector
25. Recesses for surface element
26. Plug plate
27. Surface elements of the cover part of the handgrip and connector
28. Surface elements of handgrip and connector in the forms of stipes
29. Internal chamber in the arm
30. Stiffening protrusion in the plug plate
31. Protrusion retaining the plug plate in the handgrip
32. Upper clamping protrusion for installing the plug plate
33. Lower clamping protrusion for installing the plug plate
34. Upper opening in the profile for installing the plug plate
35. Lower opening in the profile for installing the plug plate
36. Horizontal plane on which a flat portion of the lower surface of the arm
37. Plane tangent to the convex part of the contour of the handgrip
38. Plane tangent to the convex part of the contour of the handgrip
39. Incisal plane passing through the connector
40. Plane tangent to the upper part of the handgrip contour
41. Incisal plane of the handgrip
42. Linear acute angle

The invention claimed is:

1. A surface spatula, designed as a hand tool for making smooth surfaces in a construction industry comprising a frame and a working part embedded in the frame, in which the frame of the tool has a shaped handgrip and a tool holder, characterized in that it has the frame provided on the surfaces of the gripping parts with a soft, convex cover (3) made of thermoplastic plastic, wherein the cover (3) is integrally connected to a substrate on parts of outer surfaces of the spatial structure of the frame shaped in the form of a longitudinal profile (1), made of a hard structural plastic, selected from the group of plastomers consisting of polyvinyl chloride (PVC) and polypropylene, and whose spatial structure is a closed body, internally ribbed, wherein the handgrip has the same outline along an entire length of the handgrip, wherein the cover (3), also made in the form of surface elements (27), is present on the outer surfaces of the handgrip (2) and a connector (5), wherein elements of the spatial structure of the profile (1), present in the frame, in parts including the handgrip (2) and the connector (5), wherein the frontal view of the outline of the profile (1) of the frame the hand grip (2), located in an upper part of the frame, has the shape of an outline (15) similar to an ellipse and which in a lower part with gentle, concave arcs is connected with the outline of the shape of the connector (5), narrow in relation to the shape of the tool holder (4) and located in the lower part of the frame, wherein the connector (5) has in the middle of its heights a neck constriction, wherein the connector (5) is positioned asymmetrically in relation to the hand grip (2), wherein on one side of the connector (5), to its lower part, there is a spatial lateral structure of the frame attached in the form of an extended arm (8) and a support (7) is also attached on the same side of the connector (5), located below the arm (8), wherein in the frame portion between the arm (8) and the support (7) there is a tool seat (6) with a two-part, open space of a tool slot (9), consisting of a wedge part (10) and a rectangular part (11), wherein in the tool slot (9) is fixed and fastened, detachably, a seating part of the known working element for direct puttying, thin plate (16), where the seating part of the thin plate (16) is fixed longitudinally in the frame by plug plates (26), which are seated and close, detachably, a face of a spatial structure of the profile (1) of the frame, wherein the plug plate (26) has a shape corresponding to the contour of the face of the spatial structure of the profile (1) of the frame, and on the outside, the plug plate (26) has a flat surface, and on the inside, the plug plate (26) is provided with a stiffening protrusion (30), with retaining protrusions (31) and clamping protrusions (32, 33).

2. The surface spatula, according to claim 1, characterized in that the tool seat (6) in the tool holder (4) in the profile (1) of the frame, has a tool slot (9), which is part of an open, empty space along the length of the profile (1) of the frame and in a frontal view of the outline of the profile (1) of the frame, is closed on the side of the connection with the connector (5), wherein a width of the tool slot (9) consists of the width of a first wedge part (10) of the tool slot (9), located closer to the connector (5) and which is an open part of the empty space, shaped in a form corresponding to the shape of a one-sided wedge, and the tool slot (9) consists of the second of a rectangular part (11), located further from the connector (5), behind the wedge part (10) and is a part of an empty, open space, shaped in the form of a very thin cuboid, with a height much smaller than width of the very thin cuboid, wherein the tool slot (9) in the wedge part (10) has a variable height, the lowest height on the connection side with the connector (5) and the highest height at the end of width of the tool slot (9), located farthest from the connector (5) in the profile (1) of the frame, wherein the upper surfaces of the tool slot (9), in the wedge part (10) and in the rectangular part (11), together constitute the lower outer surface (12) of the wall of the spatial structure of the arm (8) in the frame, and the lower surface of the tool slot (9) is the upper, flat, outer surface (13) of the support (7) in the tool seat (6), wherein the support (7) is located as the lowest lower part of the profile (1) of the frame and connected to the lateral side of the connector (5) in a lower part of the connector (5), wherein a uniform shape of the support (7) in the tool holder (4) in the profile (1) of the frame, consist of parts composed together: part (43) directly connected with the connector (5), similar in shape to a cuboid, and a further part (44) of the support (7) distant from the connector (5), similar in shape to a one-sided wedge, whereby the width of the upper surface (13) of the support (7) is made up of the width of the surface in a rectangular part (43) and the surface in the wedge-shaped part (44), wherein the height of the support (7) in the rectangular portion (43) is at least twice the thickness of the walls in the parts including the spatial structures of the handgrip (2) and the connector (5) of the profile (1) of the frame, wherein the arm (8) in the frame is an internally ribbed spatial structure having several internal shaped chambers separated by ribs, and the arm (8) has an external shape in the form of a one-sided wedge having variable height, the greatest when connected to the connector (5), in the part located above the tool slot (9), in the wedge part (10) of the tool slot (9) and the lowest height, the arm (8) has the arm (8) end (14) farthest from the connector (5), the arm (8), wherein the end (14) is rounded from the top, wherein a total length of the arm (8) is greater than the width of the tool slot (9) by 3 to 6 times, wherein the arm (8) on the extension of the lower flat part of the surface, in the rectangular part (11) of the tool slot (9) has a distal flat part of the lower surface (12) extended to the end (14) of the arm (8).

3. The surface spatula, according to claim 1, characterized in that the profile (1) on the grip parts of the frame has, integrally bonded with a substrate, a soft cover (3) of the outer surfaces of the contour (15) of the handgrip (2) and the outline of the connector (5), in the form of surface elements (27), covering a part of the outer surfaces of the handgrip (2) and a part of the outer surfaces of the connector (5) and occurring along the entire length of the profile (1) of the frame, wherein the surface elements (27) are shaped as stripes (28), each from 1 to 15 mm wide.

4. The surface spatula, according to claim 1, characterized in that in the frame the surface elements (27) are present on the contour (15) of the hand grip (2) and the connector (5) along the length of the profile (1) of the frame, are in the form of stripes (28) arranged with an uneven circumferential pitch on the contour (15)) a handgrip (2), in the form of parallel stripes (28), wherein the stripes (28) are located on the contour of the connector (5) and on the contour (15) of the handgrip (2), and are at least arranged such that at least one strap (28) is on the side of the contour (15) of the handgrip (2) above the tool seat (6), at least one strap (28) is on the other opposite side of the contour (15) of the handgrip (2) and at least at least three strips (28) are provided on the upper contour (15) of the handgrip (2) and at least one strip (28) is provided on the lower side of the contour (15) of the handgrip (2) and at least one strip (28)) located on both sides of the contour of the connector (5), preferably in its neck constriction.

5. The surface spatula, according to claim 1, characterized in that in the spatial structures of the handgrip (2) and the connector (5) of the profile (1) of the frame, the outer walls are provided with the surface recesses (25), corresponding to a shape of the surface elements (27) and which are respectively located in the places intended for the surface elements (27), including in the form of stripes (28), wherein the recesses (25) are formed on the portions of the outer surfaces of the handgrip (2) and the connector (5), wherein more the outer walls of the spatial structures of the handgrip (2) and the connector (5) are suitably locally thickened towards the inside of the spatial structure of the frame at the locations of the recesses (25).

6. The surface spatula, according to claim 1, characterized in that in the frontal view of the profile (1) of the frame, in the spatial structure of the profile (1) of the frame, in the handgrip (2) there are several, internal hollow chambers, including side chambers (45) and (47) on both sides the contour (15) of the hand grip (2) and the lower chambers (46) in the contour (15) of the hand grip (2) and which are formed by the outer walls of the contour (15) of the hand grip (2) of the profile (1) and separated by the inner ribs of the handgrip (2), in the form of crossed ribs, and when the lower surface (12) of the arm (8) is in the horizontal position, the ribs consists of at least two vertically oblique ribs (21) and at least one oblique rib (22), wherein in the spatial structure of the arm (8) there are several hollow chambers, formed by the outer contour of the arm (8) and internally separated by several, at least four vertically oblique ribs (23).

7. The surface spatula, according to claim 1, characterized in that in the spatial structure of the profile (1) of the frame, in the tool seat (6) a seating part of the known working element for direct puttying, called a thin plate (16), is fixed and detachably fastened, in the form of a thin plate with a rounded working edge (20), in the form of a metal plate, wherein the seating part of the thin plate (16) is detachably secured in the tool holder (4) in the tool slot (9), wherein fixing of the thin plate (16) is made in a position in which one longer edge of the thin plate (16) is brought into contact, by moving until the end, with a closure of the wedge part (10) of the tool gap (9), at the point of its lowest height, which corresponds to the thickness of the thin plate (16), wherein the height of the tool slot (9), in its rectangular part (11), corresponds to the thickness of the thin plate (16) seated in the tool slot (9) and the upper surface (17) of the seating part of the thin plate (16) is fixed against the lower surface (12) of the arm (8), over the joint width of the tool slot (9) in the rectangular part (11) and the width of the distal, flat bottom part the surface (12) along the length of the arm (8) up to its end (14), and the lower part of the seating part of the thin plate (16) in the tool seat (6) adjoins the upper, flat surface (13) of the support (7) wherein in the seating part of the thin plate (16) on its upper surface (17), several, at least two local grooves (18) are made), obtained by cuts (19) through the thickness of the thin plate (16) and their vertical bends, the cuts (19) in the seating portion of the thin plate (16) made at a distance from the longer edge of the seating portion of the thin plate (16)), in places which, after fixing the retaining part of thin plate (16) in the tool seat (6), correspond to the greatest height of the wedge part (10) in the tool slot (9) and the height of which corresponds to the greatest height of the grooves (18), wherein the width of the tool holder (4) measured from the beginning of the width of the tool slot (9) in its wedge part (10), along the lower surface (12) to the end (14) of the arm (8), in relation to the total width of the thin plate (16), includes relative 4:10 ratio.

8. The surface spatula according to claim 1, characterized in that the seating portion of the thin plate (16) is longitudinally positioned between the double-sided plug plates (26) closing the faces of the profile (1) of the frame, wherein the plug plates (26) are made of a hard, structural plastic made of groups of plastomers and are externally planar plates, wherein the plug plates (26) are fixed in one of the central inner chambers (29), wherein in the spatial structure of the arm (8) of the frame, in the frontal view of the profile (1) of the frame, central chamber (29)) of the arm (8) has a trapezoidal shape with non-parallel bases, with a lower, shorter base of the trapezoid, parallel to the outer surface (12) of the arm (8), the fixing of the plug plates (26) inside the central chamber (29), through the stiffening protrusions (30) made on the surfaces inner plug plates (26), wherein the stiffening protrusions (30) are located on the walls of the inner plug plates (26), corresponding to the position of the central chamber (29) in the spatial structure of the arm (8) of the frame and the protrusions (30) have an outer shape corresponding to the shape of the chamber (29), and furthermore, the known retaining projections (31) are provided on the inner surfaces of the plug plates (26), positioned corresponding to the position of the inner chambers (45), (46) and (47) within the spatial structure of the handgrip (2) in the profile (1) of the frame, wherein the plug plates (26) have the upper (32) and lower (33) clamping projections on their internal surfaces securing each of the plugs (26) to the profile (1) of the frame, wherein each of the clamping projections (32, 33) has vertically arranged cylindrical pins, bent elastically and clamped in the assembly of the plug plates (26) to the profile (1) of the frame, in through cylindrical openings (34) and (35), made and appropriately located in the walls of the frame in the vicinity of the faces of the profile 1 of the frame, wherein the upper clamping protrusions (32) are positioned in the upper openings (34) made in the upper part of the wall of the spatial structure of the handgrip (2) of the frame and the lower clamping protrusions (33), respectively, are fixed in the lower openings (35) made in the lower part of the wall of the connector (5) of the profile 1 of the frame.

9. The surface spatula according to claim 1, characterized in that the frame and the plug plates (26) are made of engineering plastic with a hardness of 65 to 75, according to a D Shore scale, wherein the cover (3) and surface elements (27) are made of soft plastic with a hardness of 60 to 70, according to a A Shore scale.

10. The surface spatula according to claim 1, characterized in that a shape of the frontal outline of the spatial structure of the profile (1) of the frame, with its spatial arrangement in which the lower flat part of the surface (12) of the arm (8) lies on the horizontal plane (36), wherein one of planes (37) perpendicular to it, is tangent on one side to the convex part of the contour (15) of the handgrip (2) and is an incisal plane (37) passing through the tool slot (9), intersecting its wedge part (10) in the tool holder (4), wherein the second plane (38), also perpendicular to the horizontal plane (36) and tangent on the other side to the convex part of the contour (15) of the handgrip (2), is dimensionally distant from the first tangent plane (37)) to the contour (15) of the handgrip (2), in the range from 40 mm to 110 mm, wherein also another plane perpendicular to the horizontal plane (36), which is an incisal plane (39) passing through the middle part of the shape of the connector (5), the width of the neck constriction of which ranges from 10 mm to 30 mm, wherein the plane tangent (40) to the upper part of the contour (15) of the handgrip (2) and parallel to the horizontal plane (36) is dimensionally distant from 40 mm to 70 mm, moreover, an incisal plane (41), on which the longest chord of the contour shape (15) of the handgrip (2) lies, is an inclined plane (41) in relation to the horizontal plane (36), with a linear acute angle (42) the dihedral angle between these planes (36) and (41) ranges from 7° to 15°, and the vertex of the linear acute angle (42) lies on the horizontal plane (36) and is outside the end (14) of the arm (8).

* * * * *